US011365630B1

(12) United States Patent
Lighty et al.

(10) Patent No.: US 11,365,630 B1
(45) Date of Patent: Jun. 21, 2022

(54) FAN ROTOR WITH TAPERED DRIVE JOINT

(71) Applicant: Rolls-Royce North American Technologies Inc., Indianapolis, IN (US)

(72) Inventors: Kerry J. Lighty, Plainfield, IN (US); Paul O'Meallie, Brownsburg, IN (US); Brian R. Bennett, Avon, IN (US); Matthew Jordan, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 17/135,215

(22) Filed: Dec. 28, 2020

(51) Int. Cl.
*F01D 11/08* (2006.01)
*F01D 5/02* (2006.01)

(52) U.S. Cl.
CPC ..... *F01D 5/02* (2013.01); *F01D 11/08* (2013.01); *F05D 2220/32* (2013.01); *F05D 2240/60* (2013.01); *F05D 2260/31* (2013.01); *F05D 2260/40* (2013.01)

(58) Field of Classification Search
CPC . F01D 5/02; F01D 11/08; F01D 5/025; F01D 5/026; F05D 2220/32; F05D 2240/60; F05D 2260/31; F05D 2260/40
See application file for complete search history.

(56) References Cited

U.S. PATENT DOCUMENTS

| | | | | | |
|---|---|---|---|---|---|
| 2,157,838 | A * | 5/1939 | Warner | F01D 5/025 | 403/273 |
| 3,019,039 | A * | 1/1962 | Clavell | F01D 5/025 | 403/30 |
| 3,612,719 | A * | 10/1971 | Nomura | F01D 5/045 | 416/185 |
| 3,718,957 | A | 3/1973 | Shank | | |
| 3,900,270 | A | 8/1975 | Rhodes | | |
| 4,011,019 | A | 3/1977 | McDonald et al. | | |
| 4,538,969 | A | 9/1985 | Ammann et al. | | |
| 4,602,411 | A * | 7/1986 | Brown | F01D 5/025 | 29/523 |
| 4,629,354 | A | 12/1986 | Freese | | |
| 4,701,106 | A * | 10/1987 | Sasaki | F01D 5/025 | 264/262 |
| 5,131,782 | A | 7/1992 | Bruno et al. | | |
| 6,012,901 | A * | 1/2000 | Battig | F01D 5/025 | 416/244 A |
| 6,499,969 | B1 | 12/2002 | Tombers et al. | | |
| 7,182,579 | B2 | 2/2007 | Roso et al. | | |
| 10,197,065 | B2 * | 2/2019 | Yano | F04D 29/284 | |
| 10,443,604 | B2 * | 10/2019 | Harrison | F04D 25/06 | |
| 10,746,099 | B1 * | 8/2020 | Begin | F01D 5/046 | |

(Continued)

FOREIGN PATENT DOCUMENTS

DE 3625996 8/1991

*Primary Examiner* — J. Todd Newton
*Assistant Examiner* — Theodore C Ribadeneyra
(74) *Attorney, Agent, or Firm* — Barnes & Thornburg LLP

(57) ABSTRACT

A rotor assembly adapted for a gas turbine engine includes a shaft, a wheel, and a retaining nut. The shaft extends along an axis and includes a first tapered surface. The wheel is arranged circumferentially around the shaft and includes a second tapered surface. The retaining nut is fastened to the shaft and applies an axial force to the wheel to couple the wheel with the shaft.

16 Claims, 4 Drawing Sheets

(56) References Cited

U.S. PATENT DOCUMENTS

| | | | | |
|---|---|---|---|---|
| 2012/0093661 | A1* | 4/2012 | Vick | F04D 29/054 416/244 R |
| 2014/0072444 | A1* | 3/2014 | Eleftheriou | F04D 29/266 29/889 |
| 2014/0341715 | A1* | 11/2014 | Baehmann | F01D 5/282 415/122.1 |
| 2014/0369840 | A1* | 12/2014 | Pinkney | F16D 1/0858 416/204 A |
| 2015/0110628 | A1* | 4/2015 | Bouchard | F01D 5/066 416/198 A |
| 2015/0275978 | A1* | 10/2015 | Durling | F02C 7/06 29/525.08 |
| 2015/0377027 | A1* | 12/2015 | Maguire | F01D 5/025 416/219 R |
| 2016/0061107 | A1* | 3/2016 | Gorecki | F01D 5/025 415/69 |
| 2016/0069207 | A1* | 3/2016 | Bois | F01D 5/025 416/204 R |
| 2016/0298548 | A1* | 10/2016 | Brault | F02C 7/36 |
| 2017/0227014 | A1* | 8/2017 | Benjamin | F04D 29/644 |
| 2017/0335702 | A1* | 11/2017 | Porter | F01D 25/04 |

* cited by examiner

FAN ROTOR WITH TAPERED DRIVE JOINT

FIELD OF THE DISCLOSURE

The present disclosure relates generally to gas turbine engines, and more specifically to rotor joint interfaces used with gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft, which may include an attached fan. Left-over products of the combustion are exhausted out of the turbine and may provide thrust in some applications.

During operation of the gas turbine engine, torque is transferred between the shafts connecting the stages of rotating wheel assemblies or bladed rotors included in the compressor and the high pressure turbine. Torque is also transferred between the shafts connecting the stages of rotating wheel assemblies or bladed rotors included in the fan and the low pressure turbine.

SUMMARY

The present disclosure may comprise one or more of the following features and combinations thereof.

A rotor assembly may include a shaft, a bladed rotor, and a retainer nut. The shaft may extend axially along an axis for rotation about the axis. The shaft may include an outer surface having a first tapered face that may extend axially and radially at a first angle relative to the axis. The first tapered surface may be circumferentially continuous. The bladed rotor may be configured to interact with fluid around the bladed rotor. The bladed rotor may be arranged circumferentially about the shaft and include an inner surface having a second tapered face that extends axially and radially at a second angle relative to the axis. The second tapered surface may be circumferentially continuous.

The retainer nut may be fastened to the shaft and engage with the bladed rotor. The retainer nut may apply an axial force to the bladed rotor and urge the second tapered face into engagement with the first tapered face. The engagement between the first tapered face and the second tapered face may allow for frictional forces alone transmit all torque loads between the shaft and the bladed rotor. The engagement may also cause the bladed rotor and the shaft to rotate about the axis together during use of the rotor assembly.

In some embodiments, the bladed rotor may include a hub and a wheel. The hub may define the inner surface. The wheel may include a disk and a plurality of blades that extend radially outward from the disk. In another embodiment, the second tapered face may extends axially at the second angle between a first end and a second end. The first end may have a first diameter and a second end may have a second diameter. The first diameter may be smaller than the second diameter. The retainer nut may engage the hub near the first end of the second tapered face.

In other embodiments, the shaft may further include a threaded portion coupled with the retaining nut. The threaded portion may extend radially outward to a third diameter that may be smaller than the first diameter of the second tapered face. In further embodiments, the threaded portion may be spaced apart axially from the first tapered portion. A thread relief may be located between the threaded portion and the first tapered portion.

In some embodiments, all of the axial force applied by the retainer nut may be reacted by the engagement of the first and second tapered surfaces. The hub may also be free of axial engagement at the second end.

In another embodiment, the hub may include a hub body and a flange. The hub body may extend circumferentially about the axis. The flange may extend radially outward away from the hub body. The disk may be coupled with the flange for rotation with the hub. In further embodiments, the wheel may include a second disk. The first disk may couple to a first side of the flange and the second disk may couple to the flange on a second side opposite the first side.

In other embodiments, the hub and the disk may be integrally formed to define a one-piece, unitary component. In some embodiments, the hub may include a hub body and a seal. The hub body may extend circumferentially about the axis and define the inner surface. The seal may extend radially outward away from the hub body. In further embodiments, the second angle of the second tapered face may be greater than the first angle of the first tapered face relative to the axis.

According to another aspect of the present disclosure, a rotor assembly may include a shaft, a wheel, and a retaining nut. The shaft may extend axially along an axis for rotation about the axis. The shaft may include a first tapered face that is radially outward facing and circumferentially continuous. The wheel may be arranged circumferentially about the shaft. The wheel may include a second tapered face that is radially inward facing and circumferentially continuous. The retaining nut may fasten to the shaft. The retaining nut may be configured to apply an axial force to the wheel so that the second tapered face engages the first tapered face. The engagement of the first and second tapered faces may allow for frictional forces alone to transmit all torque loads between the shaft and the wheel during use of the rotor assembly.

In some embodiments, the wheel may include a hub, a flange, and a disk. The hub may extend circumferentially around the axis and define the second tapered face. The flange may extend radially outward from the hub. The disk may extend axially away and radially outward from the flange. In another embodiment, the second tapered face may extend axially between a first hub end and a second hub end. The first hub end may have a first diameter and a second hub end may have a second diameter. The second diameter may be greater than the first diameter to define a second angle. The first tapered face may extend axially between a first end and a second end. The first end may have a third diameter and a second end may have a forth diameter greater than the third diameter to define a first angle.

In other embodiments, the retaining nut may engage a forward face of the hub near the first hub end. An aft face of the hub near the second hub end may be free from axial engagement. In further embodiments, the shaft may include threads axially spaced apart from the first tapered face. The threads may extend radially outward to a thread diameter that is smaller than the first diameter at the first hub end. In another embodiment, all of the axial force applied by the retaining nut may be reacted by the engagement between the first tapered face and the second tapered face.

According to another aspect of present disclosure, a method of transferring torque in a rotor assembly may include the steps of engaging a first tapered face of a shaft with a second tapered face of a bladed wheel, coupling a retaining nut to the shaft, applying an axial force to the bladed wheel with the retaining nut to cause a normal force between the first tapered face of the shaft and the second tapered face of the bladed wheel to form a frictional drive joint between the shaft and the bladed rotor, and transferring all of a torque load between the shaft and the bladed rotor through the frictional drive joint to cause the bladed rotor and the shaft to rotate about an axis together.

In some embodiments, the bladed wheel may include a hub, a flange, and a disk. The hub may extend circumferentially around the axis and define the second tapered face. The flange may extend radially outward from the hub. The disk may extend axially away and radially outward from the flange. In another embodiment, the method may further include the step of arranging a case around the shaft and forming a seal between the bladed wheel and the case.

These and other features of the present disclosure will become more apparent from the following description of the illustrative embodiments.

DETAILED DESCRIPTION OF THE DRAWINGS

Figure 1:
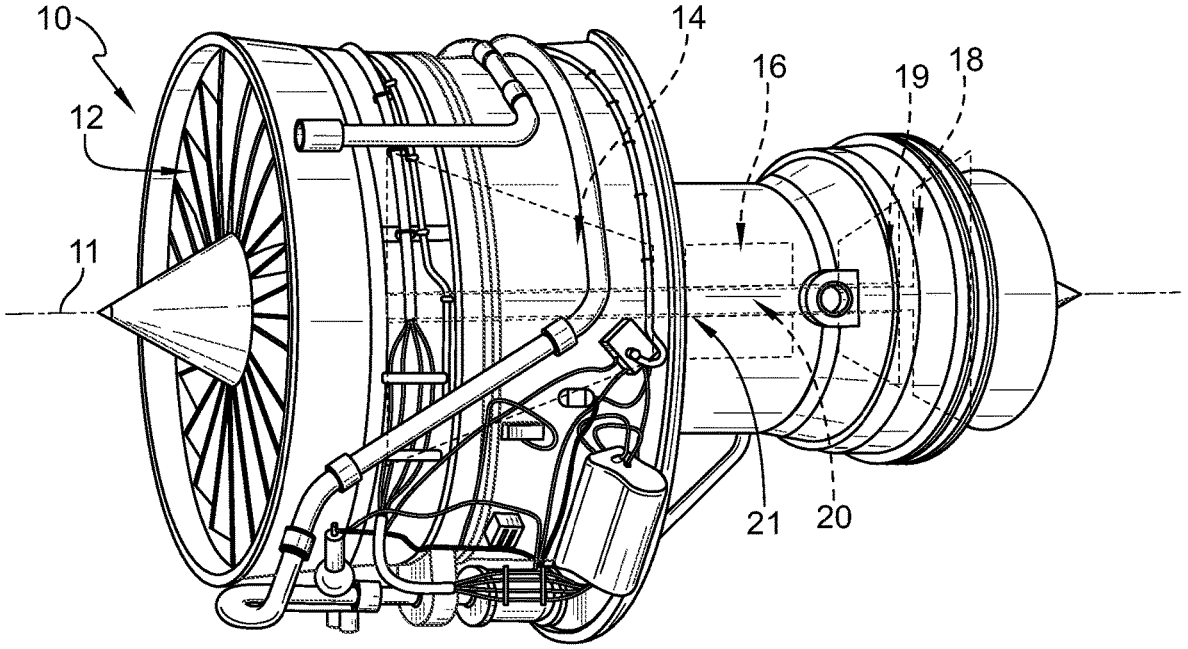
FIG. 1 is a perspective view of a gas turbine engine that includes a fan, a compressor, a combustor, a high pressure turbine, a low pressure turbine, a high pressure rotor assembly that interconnects a compressor with a high pressure turbine to transfer torque and power therebetween, and a low pressure rotor assembly that interconnects the low pressure turbine with the fan to transfer torque and power therebetween.

For the purposes of promoting an understanding of the principles of the disclosure, reference will now be made to a number of illustrative embodiments illustrated in the drawings and specific language will be used to describe the same.

Figure 2:
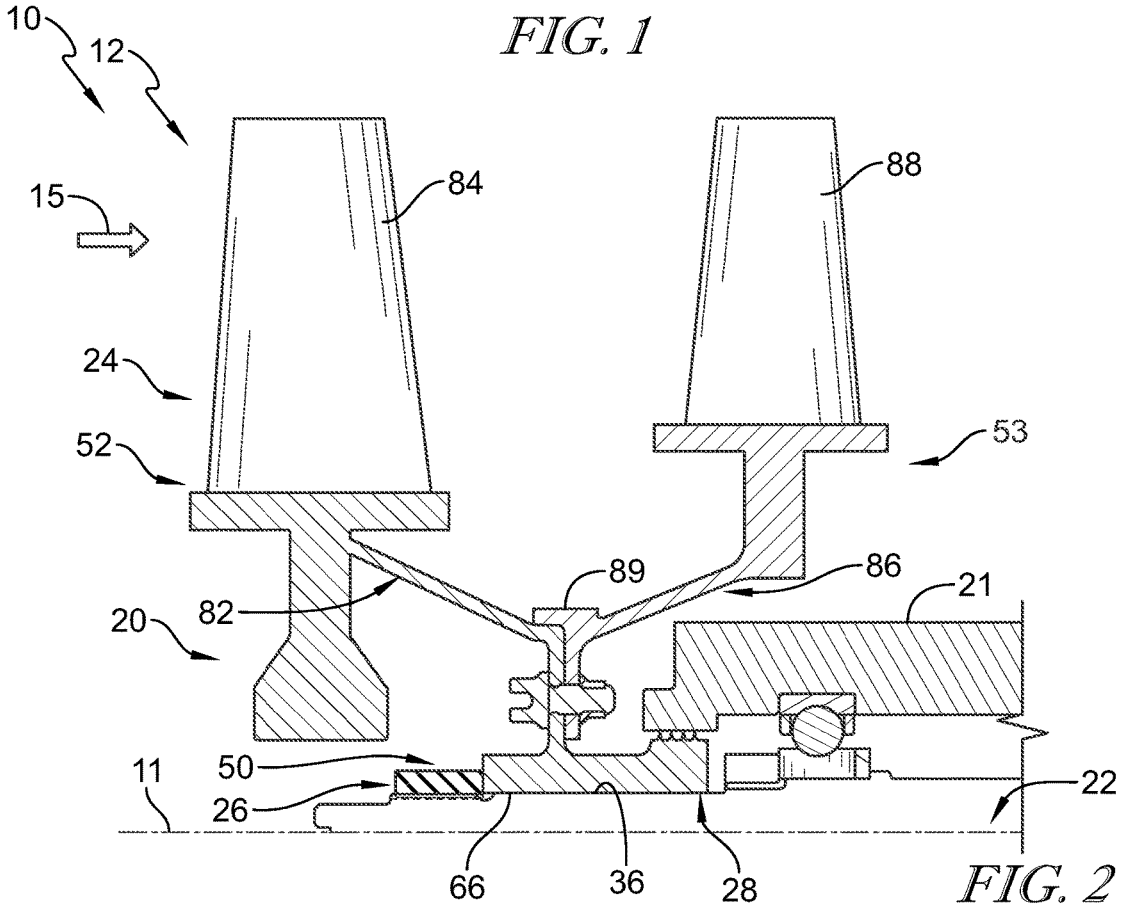
FIG. 2 is a cross-section side view of a portion of the gas turbine engine of FIG. 1 showing the rotor assembly includes a shaft, a bladed rotor, and a retaining nut, the shaft extends along an axis and includes a tapered face, the bladed wheel assembly is arranged radially outward of the shaft and includes a tapered face, and the retaining nut is fastened to the shaft and engaged with the bladed rotor to urge the tapered faces to engagement to form a frictional drive joint.

An illustrative gas turbine engine 10 includes a fan 12, a compressor 14, a combustor 16, a low pressure turbine 18, a high pressure turbine 19, a low pressure rotor assembly 20, and a high pressure rotor assembly 21 as shown in FIG. 1. The low pressure turbine 18 is interconnected to the fan 12 by the low pressure rotor assembly 20. The low pressure rotor assembly 20 includes a low pressure shaft 22, a bladed rotor 24 located radially outward of the low pressure shaft 22, and a retaining nut 26 fastened to the low pressure shaft 22 and configured to apply an axial force to the bladed rotor 24 as shown in FIG. 2. Illustratively, the bladed rotor 24 includes the fan 12. In other embodiments, the bladed rotor 24 may include one or more bladed wheels of the fan 12, the compressor 14, the low pressure turbine 18, the high pressure turbine 19, or any other rotating component of the gas turbine engine 10. The low pressure shaft 22 includes a first tapered face 36 that engages with a second tapered face 66 included in the bladed rotor 24 in response to the axial force being applied to the bladed rotor 24 by the retaining nut 26. The engagement of the first and second tapered faces 36, 66 forms a frictional drive joint 28 so frictional forces alone transmit all of the torque between the low pressure shaft 22 and the bladed rotor 24.

The present disclosure may provide a low pressure rotor assembly 20 that allows for a lower cost and/or expendable engine. The low pressure rotor assembly 20 transmits torque only through frictional forces and is free of splines or other traditional positive engagement features.

The low pressure rotor assembly 20 transfers torque and power from the low pressure turbine 18 to the fan 12 in the illustrative embodiment and includes the low pressure shaft 22, the bladed rotor 24, and the retaining nut 26 as shown in FIG. 2. The low pressure shaft 22 extends along an axis 11 of the gas turbine engine 10 and rotates about the axis 11. The bladed rotor 24 is located radially outward of the low pressure shaft 22 and engages with the low pressure shaft 22 to rotate therewith. The retaining nut 26 is fastened with the low pressure shaft 22 and engages with the bladed rotor 24 to urge the bladed rotor 24 axially to engage with the low pressure shaft 22.

Figure 3:
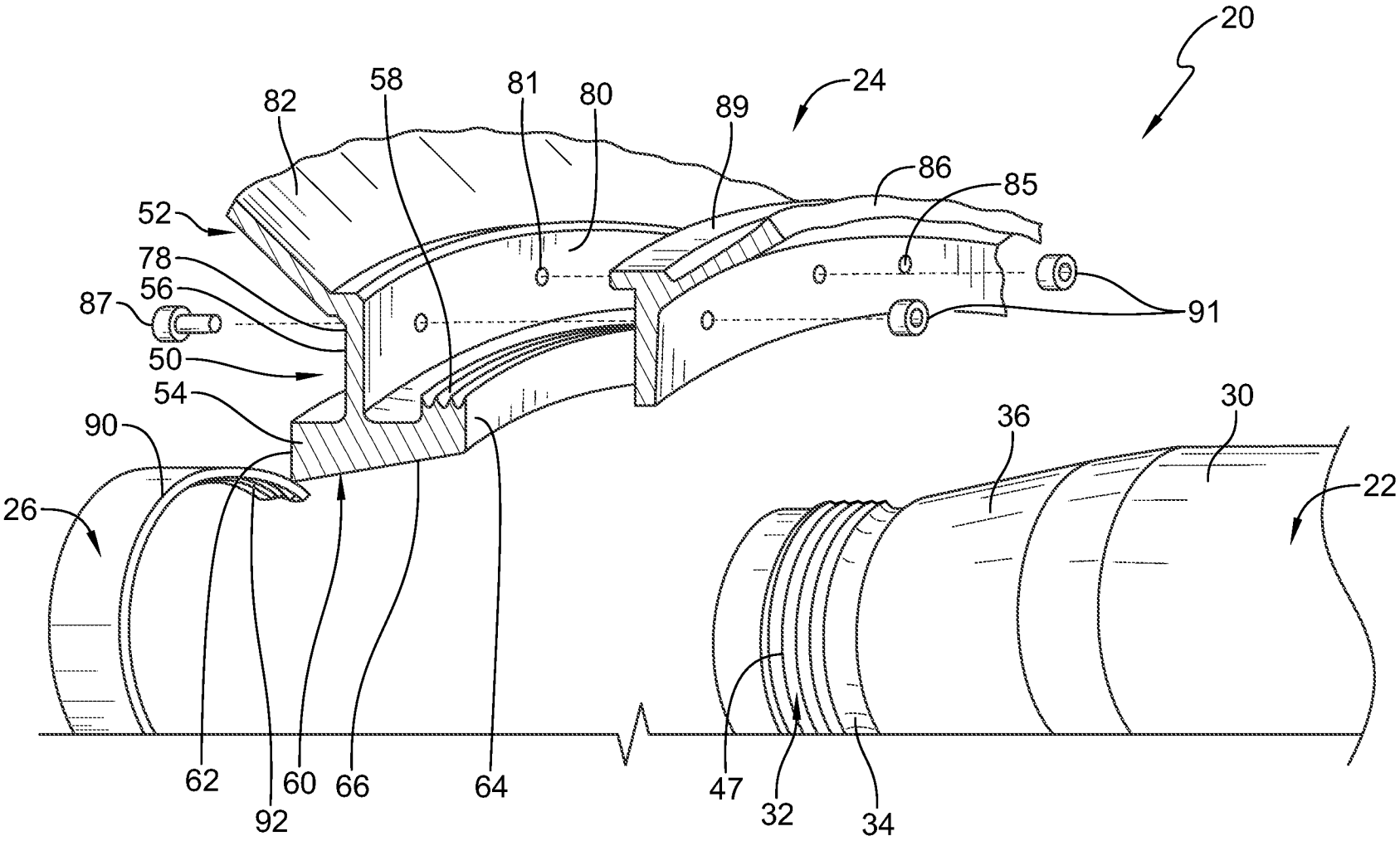
FIG. 3 is an exploded perspective view of the rotor assembly of FIG. 2 showing the bladed wheel has a hub that includes the tapered surface, a seal that extends radially outward from the hub, a flange that extends radially outward from the hub, and a first disk that is integrally formed with the flange and extends radially outward and axially forward from the flange, and a second disk that is coupled to the flange with a plurality of bolts and nuts, and extends radially outward and axially aft from the flange.
Figure 4:
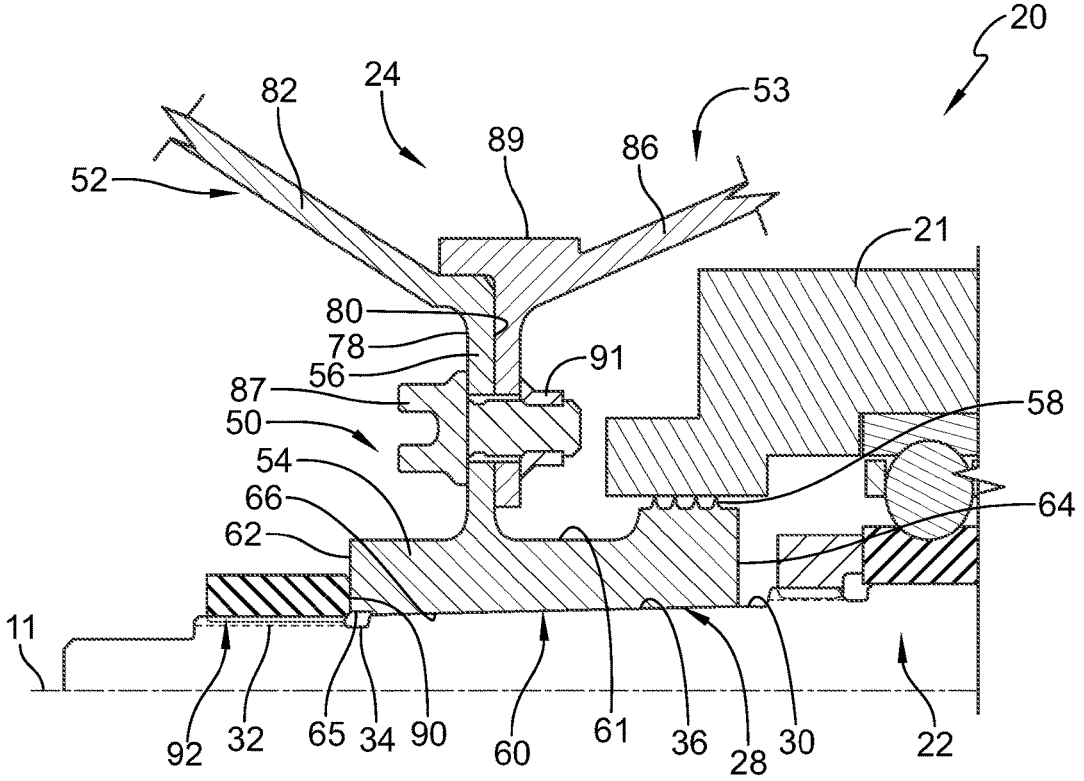
FIG. 4 is a detailed view of the rotor assembly of FIG. 2 showing the frictional drive joint, the seal included in the bladed wheel seals against a static inner case, a forward end of the hub engages with the retaining nut, and an aft face of the hub is spaced apart from any other components in the gas turbine engine.
Figure 5:
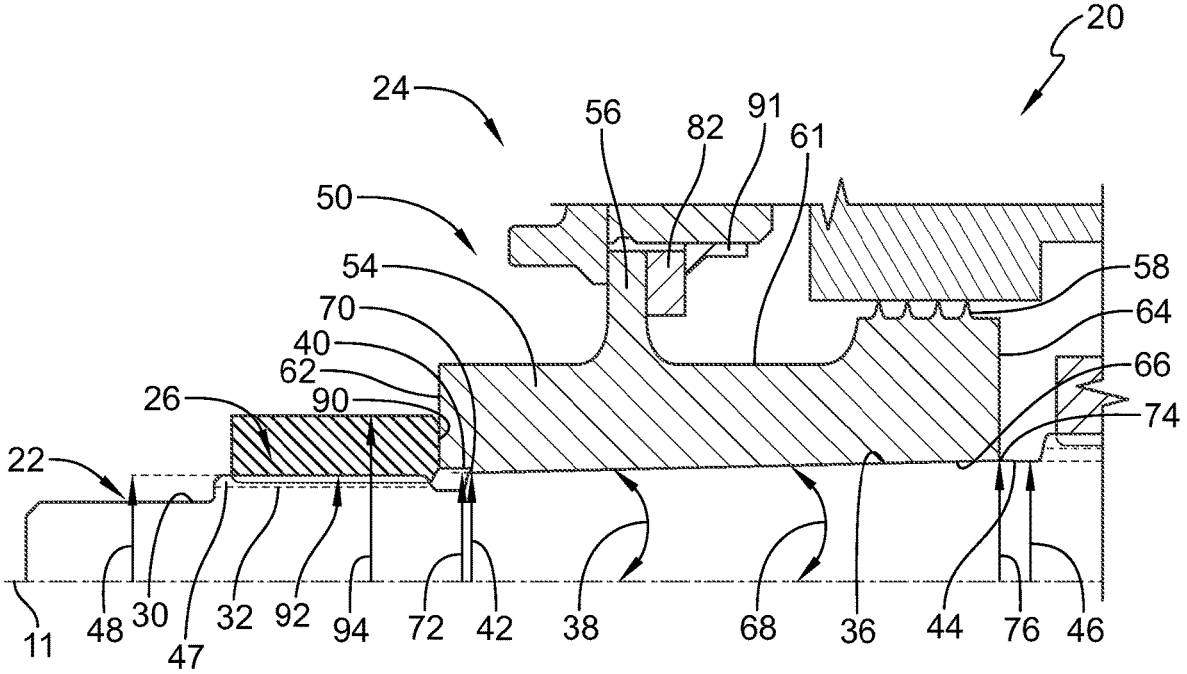
FIG. 5 is a detailed view of the rotor assembly of FIG. 2 showing a forward diameter for the tapered face of the wheel hub is larger than the outer diameter of the threaded portion of the shaft.

The low pressure shaft 22 includes an outer surface 30 having a threaded portion 32, a thread relief portion 34, and a first tapered face 36 as shown in FIGS. 3-5. The threaded portion 32 is axially forward of the first tapered face 36 and the thread relief portion 34 is located axially between the threaded portion 32 and the first tapered face 36 in the illustrative embodiment. The threaded portion 32 extends axially along the outer surface 30 a small distance to mate with the retaining nut 26. The threaded portion 32 includes threads 47 that extend radially outward from the outer surface 30 to a thread diameter 48 as shown in FIG. 5. The thread relief portion 34 extends axially along the outer surface 30 between the threaded portion 32 and the first tapered face 36. The thread relief portion 34 extends into the outer surface 30 so that it is radially inward of the threaded portion 32 and the first tapered face 36. The threaded relief portion may provide runout for machining the threaded portion 32 and/or the first tapered face 36.

The first tapered face 36 extends axially along the outer surface 30 and is radially adjacent with a hub 50 of the bladed rotor 24 as shown in FIGS. 4 and 5. The first tapered face 36 extends axially and radially at a first angle 38 relative to the axis 11 and is circumferentially continuous around the axis 11 so that no notches, protrusions, indents, or undulations are formed in the surface. The first angle 38 is constant along the length of the first tapered face 36. The first tapered face 36 extends from a first end 40 that has a first diameter 42. The first diameter 42 is greater than the thread diameter 48 so that the hub 50 fits over the threaded portion 32. The first tapered face 36 extends axially aft and radially outward to a second end 44 that has a second diameter 46. The second diameter 46 is greater than the first diameter 42. The axial distance between the first end 40 and the second end 44, and the radial distance between the first diameter 42 and the second diameter 46 form the first angle 38.

The bladed rotor 24 is located radially outward of the low pressure shaft 22 and extends into a gas path 15 of the gas turbine engine 10 as shown in FIG. 2. Torque is transferred between the bladed rotor 24 and the low pressure shaft 22 so that the low pressure shaft 22 drives the bladed rotor 24. In other embodiments, the bladed rotor 24 may drive the low pressure shaft 22. For example, the low pressure turbine 18 may transfer torque to the low pressure shaft 22 via another frictional drive joint (not shown) similar to the frictional drive joint 28. In the illustrative embodiment, the bladed rotor 24 includes a hub 50, a first wheel 52, and a second wheel 53. The hub 50 engages with the low pressure shaft 22 so that the bladed rotor 24 and the low pressure shaft 22 rotate together at the same velocity.

The hub 50 is located radially inward of the wheels 52, 53 and includes a hub body 54, a flange 56, and a seal 58 as shown in FIGS. 3-5. The hub body 54 extends axially along and circumferentially around the axis 11 and engages with the low pressure shaft 22. The hub body 54 includes an inner surface 60, an outer surface 61 radially outward and spaced apart from the inner surface 60, a forward face 62, and an aft face 64 axially spaced apart from the forward face 62. The retaining nut 26 engages with the forward face 62 to urge the hub body 54 of the bladed rotor 24 axially aft. The aft face 64 is free from engagement and spaced apart from other components in the gas turbine engine 10.

The inner surface 60 of the hub body 54 includes a counter bore 65 and a second tapered face 66 that is adjacent and engages with the first tapered face 36 of the low pressure shaft 22 as shown in FIGS. 4 and 5. The second tapered face 66 extends axially along the inner surface 60 and is circumferentially continuous around the axis 11 so that no notches, protrusions, indents, or undulations are formed in the surface. In the illustrative embodiment, the counter bore 65 is located forward of the second tapered face 66 and extends radially outward and into the hub body 54 to form a load relief step. The counter bore 65 can be sized and positioned on the hub body 54 to manage the load path through the frictional drive joint 28. The counter bore 65 may be sized radially and axially so that the beginning of the tapered surface 66 has a diameter that is greater than the thread diameter 48.

The second tapered face 66 extends axially and radially at a second angle 68 relative to the axis 11. The second angle 68 is different than the first angle 38 in the illustrative embodiment. Illustratively, the second angle 68 is greater than the first angle 38. In some embodiments, the first angle 38 is equal to the second angle 68. The second angle 68 is constant along the length of the second tapered face 66. The second tapered face 66 extends from a first hub end 70 that has a first diameter 72. The second tapered face 66 extends axially aft and radially outward to a second hub end 74 at the aft face 64, and the second hub end 74 has a second diameter 76. The second diameter 76 is greater than the first diameter 72. The axial distance between the first hub end 70 and the second hub end 74, and the radial distance between the first diameter 72 and the second diameter 76 form the second angle 68.

The flange 56 extends radially outward from the outer surface 61 of the hub body 54 and couples with the wheels 52, 53 as shown in FIG. 4. The flange 56 includes a first side 78, a second side 80 opposite the first side 78, and a plurality of holes 81. The first side 78 forms a radially extending forward face of the flange 56. The second side 80 forms a radially extending aft face of the flange 56. The plurality of holes 81 extend axially through the flange 56 from the first side 78 to the second side 80. The first side 78 is axially spaced apart from the forward face 62 of the hub body 54. The second side 80 is axially spaced apart from the aft face 64 of the hub body 54. The flange 56 is integrally formed with the hub body 54 in the illustrative embodiment.

The seal 58 extends radially outward from the outer surface 61 of the hub body 54 and is axially spaced apart from the flange 56 as shown in FIGS. 3-5. The seal 58 seals against a static inner case 21 included in the gas turbine engine 10 to block gases and/or lubricants from moving between forward and aft chambers. The seal 58 can be configured to be a labyrinth seal, a piston-ring seal, or another suitable seal arrangement. In the embodiment shown, the seal 58 is integrally formed with the hub body 54. In other embodiments, the seal 58 may be a discrete component and may be received in a channel formed in one or more of the hub body 54 and the static inner case 21.

The first wheel 52 is coupled with the hub 50 and includes a first disk 82 and a first plurality of blades 84 as shown in FIG. 2. The first disk 82 is integrally formed with the flange 56 and extends radially outward and axially forward from the first side 78. The first plurality of blades 84 extend radially outward from the first disk 82 and are located in the gas path 15. In some embodiments, the bladed rotor 24 includes the first wheel 52 and the second wheel 53 is omitted.

The second wheel 53 is coupled with the hub 50 and includes a second disk 86 and a second plurality of blades 88 as shown in FIG. 2. The second disk 86 is coupled to the second side 80 of the flange 56 and includes a plurality of holes 85 and a seal land 89 as shown in FIG. 3. The plurality of holes 85 are radially and circumferentially aligned to the plurality of holes 81 of the flange 56. A plurality of bolts 87 extend through the plurality of holes 81 of the flange 56 and the plurality of holes 85 of the second disk 86 to couple the second disk 86 and the flange 56 together with a plurality of nuts 91. The second plurality of blades 88 extend radially outward from the second disk 86 and are located in the gas path 15 axially aft and spaced apart from the first plurality of blades 84. The seal land 89 extends axially forward so that it is radially outward of the flange 56 and apportion of the first disk 82. The seal land 89 extends circumferentially around the axis 11 to form a continuous surface. The seal land 89 may be formed to include a labyrinth seal, a piston-ring seal, or another suitable seal and seal with a radially inward extending static member.

The retaining nut 26 is fastened with the threaded portion 32 of the low pressure shaft 22 and applies an axial force to the forward face 62 of the hub body 54 of the bladed rotor 24 as shown in FIGS. 4 and 5. The retaining nut 26 includes an engagement face 90 and threads 92. The threads 92 couple with the threads 47 of the low pressure shaft 22. The engagement face 90 is the aft most face of the retaining nut 26 and has an outer diameter 94 that is greater than the first diameter 72 of the second tapered face 66 and the diameter of the counter bore 65 so that the engagement face 90 engages with the forward face 62 of the hub body 54.

As the retaining nut 26 is rotated relative to the low pressure shaft 22, the threads 47, 92 engage and urge the retaining nut 26 axially aft. The engagement face 90 of the retaining nut 26 engages with the forward face 62 of the hub body 54 of the bladed rotor 24 and applies an axial force to the bladed rotor 24. The second diameter 46 of the first tapered face 36 is greater than the first diameter 72 of the second tapered face 66 so that the first and second tapered faces 36, 66 engage with one another as the bladed rotor 24 is urged axially aft relative to the low pressure shaft 22. The engaging first and second tapered faces 36, 66 form the frictional drive joint 28 that transfers all torque loads between the low pressure shaft 22 and the bladed rotor 24 through frictional forces alone. The low pressure rotor assembly 20 transfers all torque between the low pressure shaft 22 and the bladed rotor 24 without any other positive engagement features on the low pressure shaft 22 or bladed rotor 24 such as a spline, keyed groove, or tooth arrangement.

All the axial force from the retaining nut 26 is reacted by the frictional drive joint 28 so that aft face 64 of the hub 50 is free from contact or engagement from any adjacent, axially aft components. The hub 50 is not clamped between the retaining nut 26 and another structure such as a flange or ring coupled with the low pressure shaft 22. The axial force is reacted by the frictional drive joint 28 to produce a normal force that is perpendicular to the engagement surfaces of the first and second tapered faces 36, 66. The normal force may be equal to the axial force divided by the sine of the angle that is the average of the first angle 38 and the second angle 68. The normal force may be large for a small tapered face angles 38, 68 which may create a large frictional force between the first tapered face 36 and the second tapered face 66. The first angle 38 and the second angle 68 may be adjusted for different applications to vary the normal force and corresponding torque carrying capacity. Varying the first and second angles 38, 68 may also help disassembly of the frictional drive joint 28.

Figure 6:
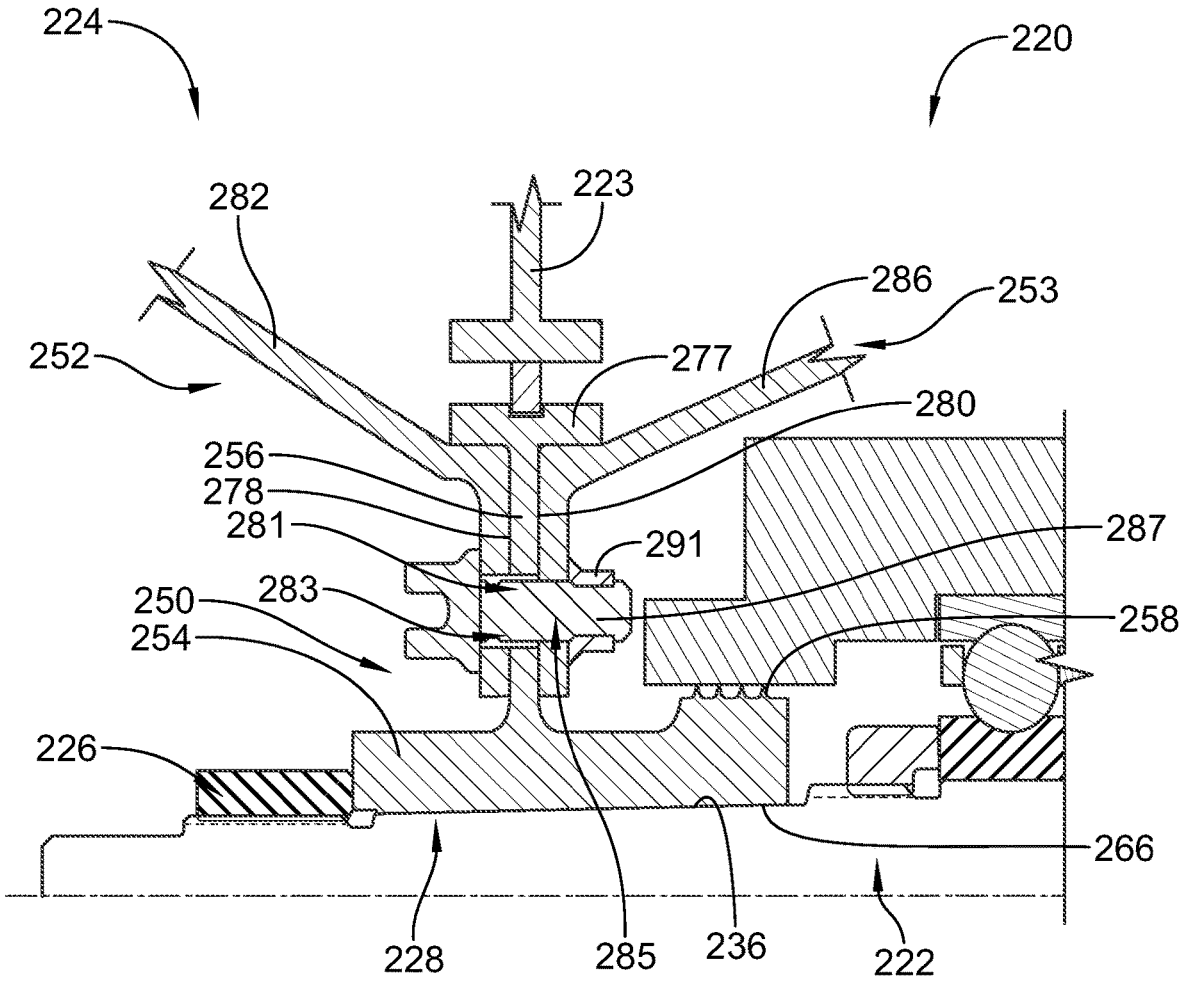
FIG. 6 is a detailed view of a second rotor assembly adapted for use with the gas turbine engine of FIG. 1 showing that the bladed rotor includes a hub, a flange that extend radially outward from the hub, a first disk coupled to a forward side of the flange, and a second disk coupled to an aft side of the flange, and the flange forms a T-shape and includes a seal that extends radially outward from the flange and seals with a static arm that is fixed with the gas turbine engine.

Another embodiment of a low pressure rotor assembly 220 in accordance with the present disclosure is shown in FIG. 6. The low pressure rotor assembly 220 is substantially similar to the low pressure rotor assembly 20 shown in FIGS. 1-5 and described herein. Accordingly, similar reference numbers in the 200 series indicate features that are common between the low pressure rotor assembly 220 and the low pressure rotor assembly 20. The description of the low pressure rotor assembly 20 is incorporated by reference to apply to the low pressure rotor assembly 220, except in instances when it conflicts with the specific description and the drawings of the low pressure rotor assembly 220.

The low pressure rotor assembly 220 includes a low pressure shaft 222 having a first tapered face 236, a bladed rotor 224 having a second tapered face 266, and a retaining nut 226 as shown in FIG. 6. The second tapered face 266 of the bladed rotor 224 engages with the first tapered face 236 of the low pressure shaft 222 to form a frictional drive joint 228 so that the bladed rotor 224 and the low pressure shaft 222 rotate together at the same velocity. The bladed rotor 224 includes a first wheel 252, a second wheel 253 and a hub 250 having a hub body 254, a flange 256, and a seal 258.

The flange 256 extends radially outward from the hub body 254 and couples with the first wheel 252 and the second wheel 253 as shown in FIG. 6. The flange 256 includes a first side 278, a second side 280 opposite the first side 278, a plurality of holes 281, and a seal land 277. The seal land 277 extends forward of the first side 278 and the aft of the second side 280 at a radially outer terminal end of the flange 256 to form a T-shape. The seal land 277 extends completely around the axis to form a continuous surface. The seal land 277 may be formed to include a labyrinth seal, a piston-ring seal, or another suitable seal and seal with a radially inward extending static member 223.

The first wheel 252 is coupled with the flange 256 and includes a first disk 282 as shown in FIG. 6. The second wheel 253 is coupled with the flange 256 and includes a second disk 286 as shown in FIG. 6. The first disk 282 is coupled to the first side 278 of the flange 256 and includes a plurality of holes 283. The second disk 286 is coupled to the second side 280 of the flange 256 and includes a plurality of holes 285. The plurality of holes 283, 285 are radially and circumferentially aligned to the plurality of holes 281 of the flange 256. A plurality of bolts 287 extend through the plurality of holes 283 of the first disk 282, the plurality of holes 281 of the flange 256, and the plurality of holes 285 of the second disk 286 to couple the first disk 282, the flange 256, and the second disk 286 together with a plurality of nuts 291.

The present disclosure may provide a low pressure rotor assembly 20 that allows for a lower cost and/or expendable engine. The present disclosure provides a low pressure rotor assembly 20 that eliminates or reduces the number of spline joints in rotating components because splines may be expensive to manufacture.

In the embodiment shown in FIG. 4, the second disk 86 is coupled with the first disk 82 for rotation therewith. This assembly may be installed onto the low-pressure low pressure shaft 22 and secured with the retaining nut 26. The inner surface 60 of the bladed rotor 24 is tapered. Correspondingly, the low pressure shaft 22 may have a matching first tapered face 36. The angles of the tapers 38, 68 may be adjusted to provide a desired normal force, interface pressure, torque carrying capacity, or may allow for ease of disassembly, or to accommodate differential axial deflections of the outer and inner pieces. The angle of the tapers 38, 68 may be the same or different.

Reliefs and counter bores 34, 65 may be done at either or both ends of either or both pieces 22, 24 to distribute the load as desired. The retaining nut 26 may provide an axial force to ensure the cone angles 38, 68 are fixed in position. As the low pressure shaft 22 rotates, aero loads from the low pressure turbine 18 may generate a torque load. This torque load is transmitted through the frictional drive joint 28 by friction. The axial clamp load may allow the frictional drive joint 28 to remain in contact and the friction between the angled surfaces 36, 68 may effectively transmit the torque. In this arrangement, the retaining nut 26 is only clamping the bladed rotor 24 and no other components. This may allow for better control of the clamp load of the frictional drive joint 28.

FIGS. 4 and 5 show enlarged views of an illustrative embodiment of the frictional drive joint 28. At the forward end, a retainer nut 26 may be used to reduce costs. To increase the thread engagement of the retainer nut 26, the end face 62 of the bladed rotor 24 may protrude axially forward beyond the end of the second tapered face 66 and overhang the thread relief 34. A counter bore may be formed in the bladed rotor 24 that may allow the inner diameter 72 to clear the maximum diameter 48 of the thread on the low pressure shaft 22 and to increase the retaining nut 26 contact area on the end face 62.

At the other end 74 of the second tapered face 66, there may be labyrinth seal knives 58. In this arrangement, incorporating the seal knives 58 to the rotor hub 50 may eliminate an additional component.

FIG. 6 shows another embodiment of the present disclosure. In this embodiment, the frictional drive joint 228 may be integrated into a stub shaft 250. The stub shaft 250 has a flange 256 that connects both the first fan rotor 282 and second fan rotor 286.

In a conventional axial flange, the load provided by the nut may be reacted by the radial flange on the opposite side of the nut, and the friction at this interface may provide the ability to transmit torque across the flange. The tapered drive arrangement 28 may react the nut 26 clamp load with the resultant axial force from the outer component 24 being forced to a higher radius over the taper 36. The normal load on the interface is the axial load multiplied by a factor of one divided by sine of the angle of the taper. For very small angles the factor may be significantly greater than 1, which may increase the torque transfer capability of the drive feature 28 relative to a traditional flange.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A rotor assembly adapted for use with a gas turbine engine, the rotor assembly comprising a shaft that extends axially along an axis for rotation about the axis, the shaft including an outer surface having a first tapered face that extends axially and radially at a first angle relative to the axis and is circumferentially continuous, a bladed rotor configured to interact with fluid around the bladed rotor, the bladed rotor arranged circumferentially about the shaft and including an inner surface having a second tapered face that extends axially and radially at a second angle relative to the axis and is circumferentially continuous, and a retainer nut fastened to the shaft and engaged with the bladed rotor to apply an axial force to the bladed rotor and urge the second tapered face into engagement with the first tapered face so that frictional forces alone transmit all torque loads between the shaft and the bladed rotor and cause the bladed rotor and the shaft to rotate about the axis together during use of the rotor assembly, wherein the bladed rotor includes a hub that defines the inner surface and a wheel that includes a disk and a plurality of blades that extend radially outward from the disk, wherein the hub includes a hub body that extends circumferentially about the axis and a flange that extends radially outward away from the hub body and the disk is coupled with the flange for rotation with the hub.

2. The rotor assembly of claim 1, wherein the second tapered face extends axially at the second angle between a first end having a first diameter and a second end having a second diameter, the first diameter being smaller than the second diameter, and the retainer nut engages the hub near the first end of the second tapered face.

3. The rotor assembly of claim 2, wherein the shaft further includes a threaded portion coupled with the retaining nut and wherein the threaded portion extends radially outward to a third diameter that is smaller than the first diameter of the second tapered face.

4. The rotor assembly of claim 3, wherein the threaded portion is spaced apart axially from the first tapered portion to locate a thread relief between the threaded portion and the first tapered portion.

5. The rotor assembly of claim 2, wherein all of the axial force applied by the retainer nut is reacted by the engagement of the first and second tapered surfaces and the hub is free of axial engagement at the second end.

6. The rotor assembly of claim 1, wherein the wheel includes a second disk and wherein the first disk is coupled to a first side of the flange and the second disk is coupled to the flange on a second side opposite the first side.

7. The rotor assembly of claim 1, wherein the hub and the disk are integrally formed to define a one-piece, unitary component.

8. The rotor assembly of claim 1, wherein the hub further includes a seal, the hub body extends circumferentially about the axis and defines the inner surface, and the seal extends radially outward away from the hub body.

9. The rotor assembly of claim 1, wherein the second angle of the second tapered face is greater than the first angle of the first tapered face relative to the axis.

10. A rotor assembly adapted for a gas turbine engine, the rotor assembly comprising a shaft that extends axially along an axis for rotation about the axis, the shaft including a first tapered face that is radially outward facing and circumferentially continuous, a wheel arranged circumferentially about the shaft, the wheel including a second tapered face that is radially inward facing and circumferentially continuous, and a retaining nut fastened to the shaft and configured to apply an axial force to the wheel so that the second tapered face engages the first tapered face and frictional forces alone transmit all torque loads between the shaft and the wheel during use of the rotor assembly, wherein all of the axial force applied by the retaining nut is reacted by the engagement between the first tapered face and the second tapered face.

11. The rotor assembly of claim 10, wherein the wheel includes a hub that extends circumferentially around the axis and defines the second tapered face, a flange that extends radially outward from the hub, and a disk that extends axially away and radially outward from the flange.

12. The rotor assembly of claim 11, wherein the second tapered face extends axially between a first hub end having a first diameter and a second hub end having a second diameter greater than the first diameter to define a second angle, and the first tapered face extends axially between a first end having a third diameter and a second end having a forth diameter greater than the third diameter to define a first angle.

13. The rotor assembly of claim 12, wherein the retaining nut engages a forward face of the hub near the first hub end, and an aft face of the hub near the second hub end is free from axial engagement.

14. The rotor assembly of claim 13, wherein the shaft includes threads axially spaced apart from the first tapered face, the threads extend radially outward to a thread diameter that is smaller than the first diameter at the first hub end.

15. A method of transferring torque in a rotor assembly, the method comprising engaging a first tapered face of a shaft with a second tapered face of a bladed wheel, coupling a retaining nut to the shaft, applying an axial force to the bladed wheel with the retaining nut to cause a normal force between the first tapered face of the shaft and the second tapered face of the bladed wheel to form a frictional drive joint between the shaft and the bladed rotor, and transferring all of a torque load between the shaft and the bladed rotor through the frictional drive joint to cause the bladed rotor and the shaft to rotate about an axis together, further comprising arranging a case around the shaft and forming a seal between the bladed wheel and the case.

16. The method of claim 15, wherein the bladed wheel includes a hub that extends circumferentially around the axis and defines the second tapered face, a flange that extends radially outward from the hub, and a disk that extends axially away and radially outward from the flange.

* * * * *